United States Patent [19]

Deem

[11] Patent Number: 4,961,539

[45] Date of Patent: Oct. 9, 1990

[54] TRUCK-MOUNTED PALLET CHIPPER

[76] Inventor: K. Michael Deem, 1123 N. High, Lancaster, Ohio 43130

[21] Appl. No.: 388,020

[22] Filed: Aug. 1, 1989

[51] Int. Cl.[5] ..... B02C 21/02

[52] U.S. Cl. ..... 241/36; 241/101.7

[58] Field of Search ..... 241/36, 101.7, 280, 241/285 R, 285 A, 285 B

[56] References Cited

U.S. PATENT DOCUMENTS

| | | | |
|---|---|---|---|
| 1,886,537 | 11/1932 | Evans et al. | 241/101.7 X |
| 3,189,286 | 4/1963 | O'Connor | 241/101.7 |
| 3,530,912 | 9/1970 | Freeman | 241/101.7 |
| 3,752,409 | 8/1973 | Lewis | 241/101.7 |
| 3,913,850 | 10/1975 | Daniel | 241/101.7 |
| 3,929,294 | 8/1974 | Cox | 241/101.7 |
| 4,078,640 | 3/1978 | Nickel et al. | 241/101.7 X |
| 4,101,081 | 7/1978 | Ritter et al. | 241/101.7 |
| 4,390,132 | 6/1983 | Hutson et al. | 241/101.7 |
| 4,796,819 | 1/1989 | Waterman | 241/101.7 X |

FOREIGN PATENT DOCUMENTS

| | | | |
|---|---|---|---|
| 2312599 | 5/1975 | France | 241/101.1 |

*Primary Examiner*—Timothy V. Eley

*Attorney, Agent, or Firm*—Watkins, Dunbar & Pollick

[57] ABSTRACT

A shredder for reducing used solid waste material to chips is described. The shredder and a storage container for the shredded wood are a part of a single mobile unit for on-site shredding and removal of shredded waste. A single drive engine is used to propel the vehicle in typical highway travel mode and also to power the shredder and auxiliary motors. A special vehicle drive unit/shredder coupling system is used to minimize torsional stress and strain on the drive engine. A lift mechanism is used to lift the pallets into the shredder and a paddle/pressurized air system is used to convey the shredded waste to an attached trailer.

46 Claims, 8 Drawing Sheets

FIG. 3
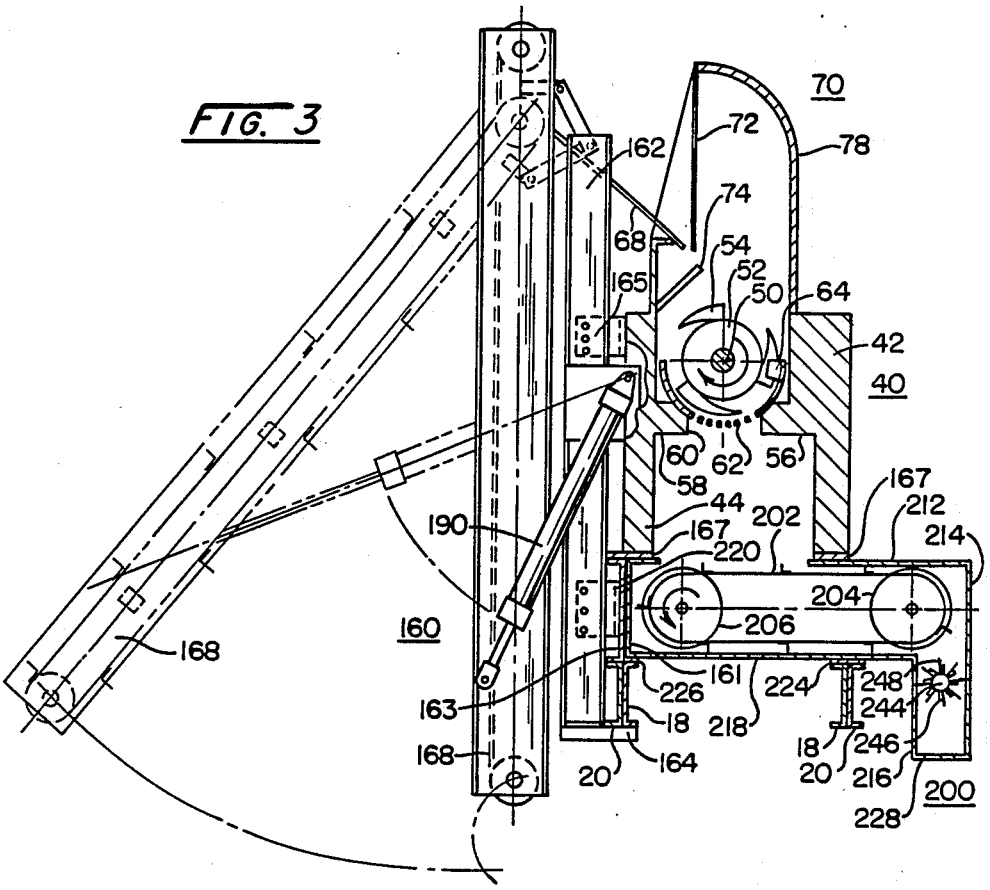
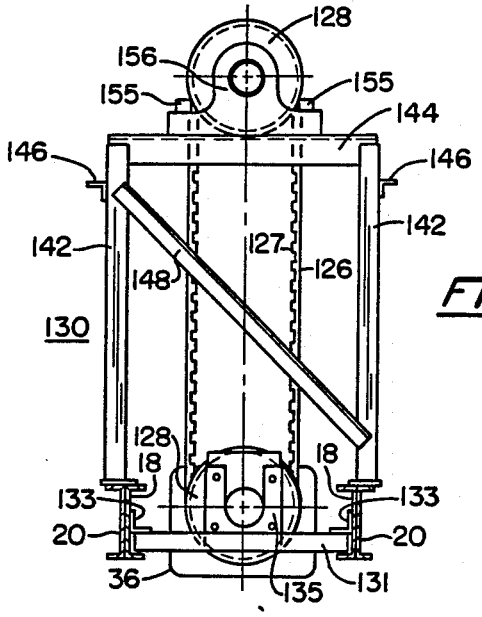
FIG. 4

TRUCK-MOUNTED PALLET CHIPPER

FIELD OF THE INVENTION

This invention relates to solid waste material shredders. More particularly, it relates to a mobile, truck mounted waste wood shredders or chippers.

BACKGROUND OF THE INVENTION

A wide variety of materials are stacked on wood pallets. Both pallets and the material stacked on them can be easily moved with a fork-lift or other standard handling equipment. Once the material on the pallet has been removed, the pallet remains. Generally pallets are not reused and as a result present a disposal problem for the owner. State and local fire and pollution laws prevent disposal by burning while most trash removal services will not accept used pallets. More often then not the pallets are simply stacked outside of buildings where they become a nuisance, safety hazard and eyesore.

Various devices have been developed for shredding various materials. However, none of these devices provide a mobile, highway travelable machine that uses a single power source for both locomotion and shredder operation. None of these devices suggests a single-drive machine that can be driven to the site of the pallets, shred the pallets, and then driven away with the shredded material.

Examples of the prior art include U.S. Pat. No. 3,752,409 to Lewis, Aug. 14, 1973 that describes a railroad tie shredder mounted on a flat bed railroad car. The invention has a crane for picking up uniform-size ties and placing them on a conveyor which advances them into a cutting and punching mechanism. The resulting fragments are discharged along the railroad bed by means of a blower. This invention uses a diesel engine to drive the shredder and a hydraulic motor to power the railroad car upon which the shredder is mounted. The diesel motor unit is designed primarily for use with the shredder, i.e., the cutting and punching mechanism. Because of the reliance on a hydraulic motor, the railroad car itself can travel at only two speeds, a fast speed of about 25 mile per hour and a slow creeper speed of about 1 to 10 miles per hour. Because of these slow travel speeds, this device is not functional as a highway vehicle. Furthermore, the machine is designed with little consideration for the length, width, and weight limitations imposed on users of the highway system. A vehicle of the type described in the Lewis patent would simply not be allowed on the highways because of its immense size and weight. Moreover the Lewis machine discharges the shredded wood product on the ground along the railroad bed, a practice that would hardly be allowed by the private land owners along our highway systems and has little relevance when one considers that pallet shredding is done on site and not along the roadway. To simply discharge the shredded wood product on the ground at the site of the pallets would simply trade one problem for another, i.e,, it would replace a pile of pallets with a pile of wood chips.

Furthermore, unlike multi-sized pallets, railroad ties are of uniform size enabling the use of specifically designed conveyors, cutters, and lifting equipment for a specific material. Pallets come in multiple sizes and shapes and therefor require a different design for handling.

U.S. Pat. No. 3,929,294 to Cox, Dec. 30, 1975, discloses a device for reducing scrap lumber and waste forest products found along the roadway into uniform short lengths. The wood breaker is powered by a motor which is separate and distinct from the power source used to transport the invention to the work site. Furthermore, the shredded product from the Cox invention is conveyed to a separate transporting truck for hauling; the wood to be shredded must be loaded with separate equipment such as a shovel loader or similar equipment.

U.S. Pat. No. 4,390,132 to Hutson et al., June 28, 1983 describes a wood chipper for reducing trees to wood chips. This invention uses a separate engine to drive the chipping mechanism and is transported to the work site by means of a vehicle with its own motor. A separate truck is used to remove the reduced wood chips.

French Demande No. 2,312,599 to Lager Jan. 28, 1977 discloses a machine for chopping wood from discarded pallets or packing cases into small pieces and removing the iron from the pieces in order that the shredded wood maybe used for paper making. The invention is placed on a trailer bed for towing by a truck and uses a separate self-contained engine for driving the pulverizing apparatus.

U.S. Pat. No. 3,189,286 to O'Connor, June 15, 1965, reveals a paper shredding apparatus in which the engine for driving the apparatus is separate and distinct from the engine used to convey the apparatus from location to location. The size of such an apparatus and the power source to operate it are not comparable to the size of the power source required to shred wooden pallets.

U.S. Pat. No. 3,913,850, to Daniel, Oct. 21, 1975, reveals a mobile tire shredder in which the motor for shredding the tires is separate and distinct from the engine used to drive the vehicle.

As is apparent from the prior art, previous inventors have used a separate power source to operate mobile shredder devices. Even U.S. Pat. No. 3,752,409 uses a diesel engine to drive the shredder and an auxiliary hydraulic motor to drive the railroad car.

A separate shredder drive engine is used because the engine used to move the vehicle on which the shredding apparatus is mounted is not suited for operating the shredding apparatus. Typically an engine used to move the shredder vehicle on the highway operates at relatively high speeds without substantial loading being placed upon the engine. If such an engine were hooked to a shredding machine, the large load and torsional resistance of the large pieces of wood as they are being shredded would place such great stress and strain on the vehicle engine and its associated transmission that such engine and transmission would be rendered inoperable within a very short period.

Although stationary wood shredders are known, they are not designed for mobile use. A typical stationary shredder is securely mounted on a concrete pad and is often over fifteen feet tall. Because of height requirements placed on highway users, such shredders are not capable of being mounted on a truck chassis. Furthermore, the vibrational and torsional drive shaft stress produced by a stationary shredder do not allow for direct connection to a vehicle motor and transmission.

SUMMARY OF THE INVENTION

The present inventor has solved all of these problems by combining into one highway vehicle a heavy duty wood chipper, an ample storage device for the reduced wood pieces, and an engine that serves not only to drive the vehicle at normal highway speeds but also to operate the wood chipper.

The present invention is a mobile wood-reducing machine for reducing waste wood such as that found in pallets to wood chips and is capable of operating on highways and roads under normal conditions and at usual highway speeds. The vehicle itself is a typical heavy-duty highway-type truck with reinforced flat-bed type chassis. A heavy duty shredding apparatus is mounted on the chassis so that the rotor shaft shredding device is in parallel alignment with the axis of the truck drive shaft, i.e. longitudinal with respect to the length of the truck. A single drive means, that is, the truck engine, is used to selectively operate the truck and the shredding apparatus. Because of the large torsional stress and strain produced by the shredding apparatus during operation, it is connected to the truck engine with a coupling means so as to minimize torsional stress and strain on the truck engine and transmission.

The shredding device has a lifting device which is used to lift wood from a loading or operator position into a receiving port or opening on top of the shredding device. Waste wood from the shredder is removed to a storage bin attached to the truck by means of a conveyor system or a high pressure air system or both.

In order to minimize the stress and strain transmitted by the grinding of waste wood in the shredder to the truck engine and transmission, a number of devices are placed between the shredder and the truck engine. One such device is a large and substantial fly wheel mounted on the rotor (drive shaft) of the shredding device. A second device is a coupling device placed between the truck engine drive and the shredder drive shaft. Such a coupling device can be a dry fluid coupling means in which the shocks and stress of the shredding device are not passed back to the transmission and engine of the truck. In such a dry fluid coupling means, coupling takes place as a result of centrifugal force driving a dry fluid such as metal shot to an outward position so as to lock the vanes of the output shaft with the input shaft. In order to obtain optimal efficiency from such a dry-fluid coupling means, it is essential that the rotational speed of the input shaft, i.e., truck motor drive shaft be held to a constant value. As such, the rotational speed of the truck is controlled with a governor, preferably an electronic governor.

In order that the wood may be placed into the shredder with minimum risk to the safety of the operator, a lifting device is used to lift the wood from operator level into the top of the shredder which, because of its height, is virtually unaccessible to personnel working in and around the shredder. This lifting device consists of two frame members attached to the chassis of the truck and the shredder in an upright position next to and near the ends of the side of the shredder housing. A shallow box-like structure with two sides and a bottom is pivotally attached to the upright members at a point near the top of the upright members. One or more pallets are placed in the box while it is in its lowered position and then raised to an upright position for emptying of its contents into the shredder. The lifting device is raised to its emptying position by means of a power unit such as a hydraulic piston.

When lifted to its dumping or emptying position, a special sweeping device pushes the pallets and other wooden objects in the box into the shredder. The sweeping device consists of a pair of chain and sprocket assemblies mounted on the inside of the sides of the box. The two chains of the chain and sprocket assembly are transversely joined to a push plate which is essentially parallel to the bottom and top of the box and located within the box. When the box is in the upright or emptying position, the push plate is activated and pushes the pallets and other materials in the box into the receiving port of the shredding apparatus. After the push plate reaches the top of the box, i.e., has pushed all of the material into the shredder, it is returned to a lowered position where it is ready for the next loading of the pallet box. Typically and preferably the push plate is operated by a hydraulic motor.

Typically the engine for driving both the shredder and the truck itself is a heavy duty truck-type diesel engine. A heavy duty transmission is provided for varying the speed and torque of the output shaft from the transmission so as to provide the truck with the normal range of highway operating speeds. A take-off device or power tower is used to selectively connect the transmission output shaft to the truck drive means, that is, the truck wheels, or to the drive shaft of the shredder device. As previously mentioned, when the transmission output is connected to the shredding device, such connection takes place through a torsional stress and strain reducing apparatus such as a dry-fluid coupling device. Other types of coupling devices or more than one coupling device may be used.

To further provide for the torque requirements of the truck and the shredder, a second transmission can be placed between the first transmission and the shredder and truck drive wheels. The power take off (power tower) is then located on the second transmission and is used to switch operation between the truck drive wheels and the shredder.

The selection device for switching between vehicle drive and shredder drive is designed so that only one drive can be used at anyone time. Preferably the selection device is an electric over air solenoid valve. When the device is energized, a first cylinder disengages the truck drive while a second cylinder engages the shredder drive. When the solenoid valve is de-energized, the first cylinder engages the truck drive and the second cylinder disengages the shredder drive.

To protect the truck engine, a special shut-off device is used with the shredder which cuts off the engine should the shredder lock up or stall or if the shredder blades fall below a certain number of revolutions per minute (RPM) because of jamming wood pieces. Furthermore, the truck engine is equipped with a special heat sensing device which also shuts of the engine should the truck engine become over heated due to abnormal work loads being place on it or if the oil pressure drops below a certain level.

The shredder output from the engine drive is hooked to the shredder drive shaft by means of a belt and pulley device. Although conventional V shaped pulleys and belts may be used, the large amounts of strain on the pulleys produced by the shredder stretches the belts and make them inoperative in a short period of time. To avoid this problem, a special flat-notched belt is used with a flat grooved transversely-notched pulley. By using such a notched or timing chain-like pulley, the abnormal belt stretching produced by the shredder is thereby avoided.

The shredder itself consists of a heavy duty box-like housing which is mounted to the chassis in such a manner that the axis of the shredder drive is parallel to the truck drive axis. The drive shaft of the shredder has a drum securely attached to it. The drum is located within the box-like housing and has attached to it a series of cutter blades which are arranged in rows parallel with the axis of the cutter shaft and with spacing between these cutters to accommodate anvils which are mounted on a semi-circular plate which conforms in shape generally to a cylinder defined by the outer edges of the rotating outer blades. This semi-circular plate is mounted below the blades of the drive cutters by attaching it to two ledge-like projections which project from the sides of the housing. The semi-circular plate has holes at the bottom for allowing the shredded wood to pass into the exit port of the shredder which is located beneath the hemispherical plate.

After the shredded wood passes through the holes in the semi-circular plate below the cutter blades and through the outlet port of the shredder, it is conveyed to a storage facility by a suitable removal means. Such means may be a conveyor type apparatus, a pressurized discharge duct or a combination of the two. Another removal means consists of several sweeper paddles that move the wood chips along a slanting duct passage and into a pressurized air duct. The conveyor duct or sweeper paddle duct is located immediately beneath the shredder exit port and has an inlet port which allows the shredded wood to fall into it.

The conveyor system consists of two rollers mounted through the front and back of the duct with a conveyor belt placed around the rollers. The conveyor belt is positioned such that the wood chips falling through the hemispherical plate fall on the belt at one end and are then conveyed to the opposite end where they enter into a pressurized air duct system. One of the rollers of the conveyor belt is a drive roller which is operated by a hydraulic motor. Preferably the conveyor system is mounted transversely across the chassis of the truck and below the shredding machine so as to convey the shredded wood chips to the side of the vehicle. As the wood chips reach the end of the conveyor they fall into a discharge port which is connected to a pressurized air stream duct.

In another and preferred version, one or more sweeper shafts are placed in the duct. Sweeper paddles are attached to the shaft and shove the shredded wood along the floor of the duct in the direction of rotation of the sweeper shaft. Eventually the shredded wood is pushed into the pressurized air stream duct.

Shredded wood from the conveyor system enters a duct of the pressurized air system through a passage that is provided with an air lock system. The air lock system consists of a cylindrical pipe which has an upper and lower slot through the which the wood chips pass. A rotatable air lock shaft is mounted longitudinally within the cylindrical pipe with at least two resilient paddles mounted radially along the length of the air-lock shaft and touching the sides of the cylindrical pipe so that at least two resilient paddles are always in contact with the opposite sides of the cylindrical pipe so as to prevent the pressurized air from entering into the conveyor and shredder housing thereby creating a back flow of air and forcing shredded wood back into the shredder. The air lock shaft is driven by a hydraulic motor. The air lock housing, the exit port of the conveyor housing, and the pressurized air ducts may have transparent, shatter proof ports to allow visual observation of any blockage that may occur within the chip removal system.

The pressurized chip removal system consists of a blower assembly with an air intake port and an air discharge port which leads into an air duct system which has an opening for receiving wood chips from the shredder and conveying them to a storage unit. One or more air deflection plates are mounted in the pressurized air duct in the region where the wood chips enter the air duct so as to minimize air flow into the shredder apparatus and to create a partial vacuum whereby the shredded chips are sucked in the pressurized air stream. The fan assembly is driven by a hydraulic motor. After the wood chips merge with the pressurized air stream, the chips are carried through duct work to a suitable storage container.

Preferably the wood chips are discharged from the pressurized air duct system into an enclosed trailer attached to the rear of the vehicle chassis. The trailer attachment means is designed so that when the operator reaches the work site, he can lock the trailer wheels with a breaking mechanism, unlock the trailer attachment means and allow it to slide forward on the chassis. As a result the air discharge duct is backed into a fill hole located at the top corner of the front wall of the enclosed trailer. A return air hose from the trailer to the blower intake is used to relieve any excessive air pressure in the trailer. After the job is complete, the air discharge duct is pulled out of the trailer and the trailer attaching means locked to the chassis for transport to an unloading area.

All electrical devices are operated from the truck batteries and alternator system. An electronic governor is used to control the speed of the engine while the vehicle is operating in shredding mode. The pallet feed conveyor is electronically controlled. One switch is used to start the push plate while another switch operates the lift cylinder and continues the push plate on its upward course. A third switch reverses the push plate and lowers the lift cylinder. Five shut down switches are available to turn off the truck engine. One shut down switch is controlled by the shredder rotational speed, another by engine oil pressure, a third by engine temperature, while the other two switches are operator emergency shut down switches.

A hydraulic system is used to operate the conveyor system including the conveyor lift cylinder and the motors that operates the push plate. Hydraulic motors are used to operate the air blower of the pressurized air system, the shredded chip conveyor or paddle system and the air lock system.

A hood is placed over the shredder to stop chips from flying out of the machine. The hood has an opening on the feed conveyor side with a belting cover closing it. When the conveyor is in the up position, the push plate pushes the pallet into the shredder. The belting stops chips from leaving the shredder opening. A deflection plate above the cutting blades and angled away from the hood opening also reduces the number of chips that are thrown from the shredder. The hood is tall enough to allow the feed conveyor to feed pallets into the shredder but low enough to meet highway height limits.

It is the purpose of this invention to provide in one mobile unit a device for reducing pallets to shredded pieces of wood through the use of a single engine capable of operating both the mobile unit and the shredder plus any additional motors required for the overall operation of the mechanism.

It is a further purpose of this invention to accomplish these objectives while minimizing the mechanical complexity of the apparatus and thereby increasing its reliability and operating life. Other objects and features of the invention will be apparent and understood from the detailed description of the invention and the accompanying drawings which fallow. The foregoing and other advantages of the invention will become apparent from the following disclosure in which a preferred embodiment of the invention is described in detail and illustrated in the accompanying drawings. It is contemplated that variations in procedures, structural features and arrangement of parts may be made by persons skilled in the art without departing from the scope or sacrificing any of the advantages of the invention.

BRIEF DESCRIPTION OF THE DRAWINGS

FIG. 3. is a transverse vertical section taken on line number 3—3 of FIG. 1;

FIG. 4. is a transverse vertical section taken on line 4—4 of FIG. 1;

Figure 1:
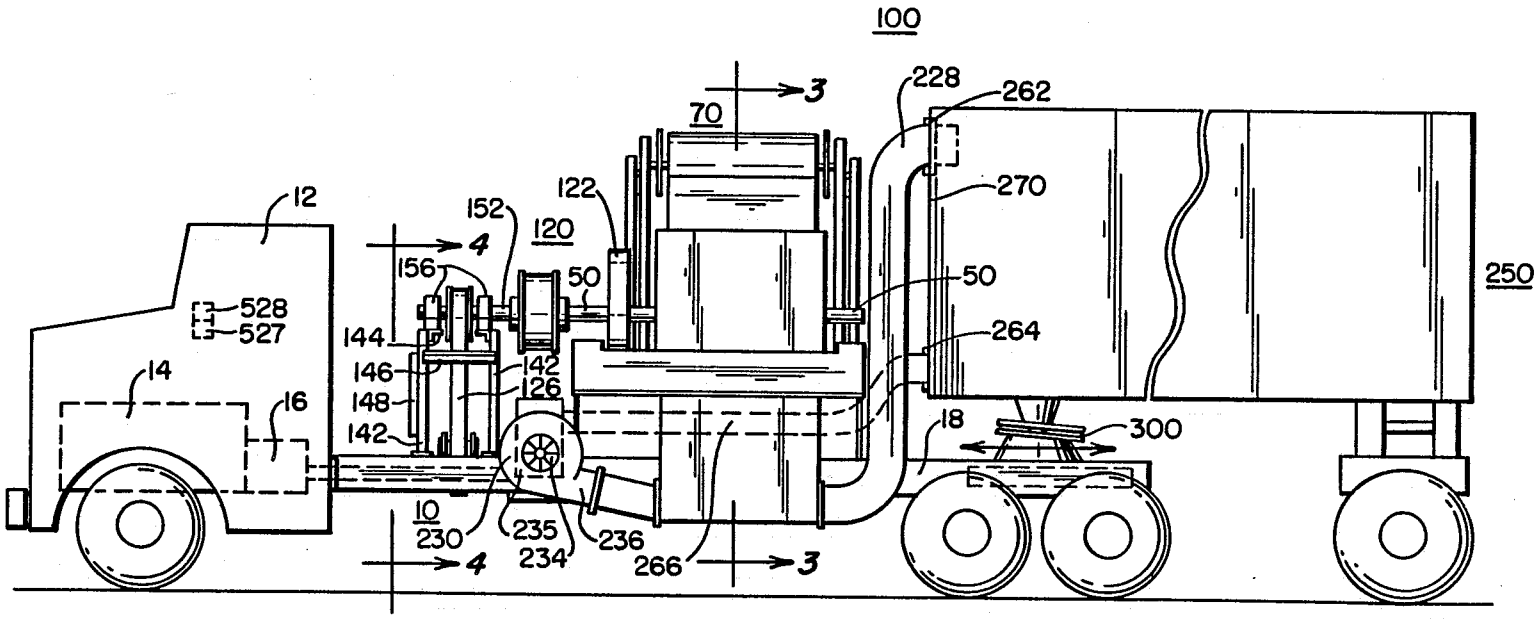
FIG. 1. is a side elevation showing a shredding machine and transport vehicle according to a preferred embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has herein been described, it will be understood that various changes and modifications in the illustrated and described structure can be affected without departure from the basic principals that underlie the invention. Changes and modifications of this type are therefore deemed to be circumscribed by the spirit and scope of the invention, except that is the same may be necessarily modified by the appended claims or reasonable equivalents thereof.

DETAILED DESCRIPTION OF THE INVENTION AND THE BEST MODE FOR CARRYING OUT THE PREFERRED EMBODIMENT

Figure 2:
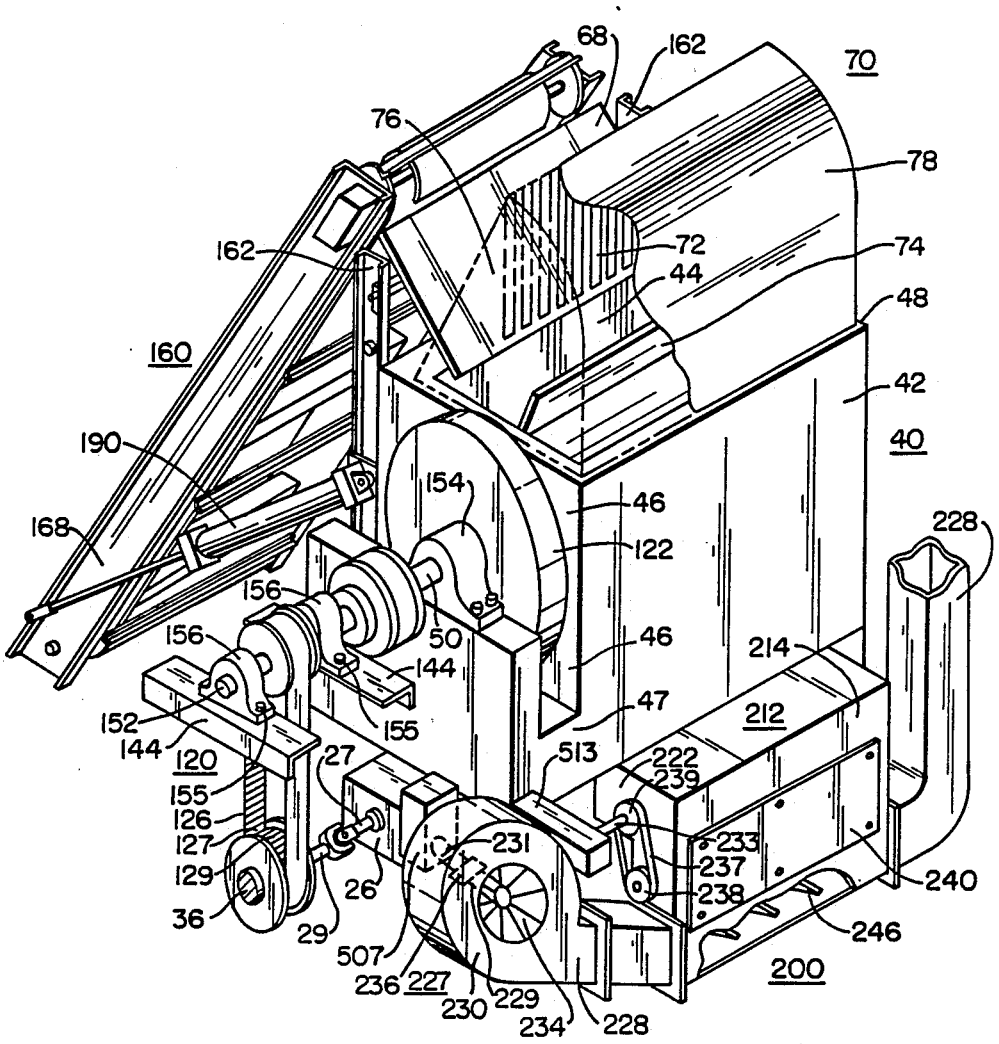
FIG. 2. is a side perspective view of the shredder mechanism.
Figure 10:
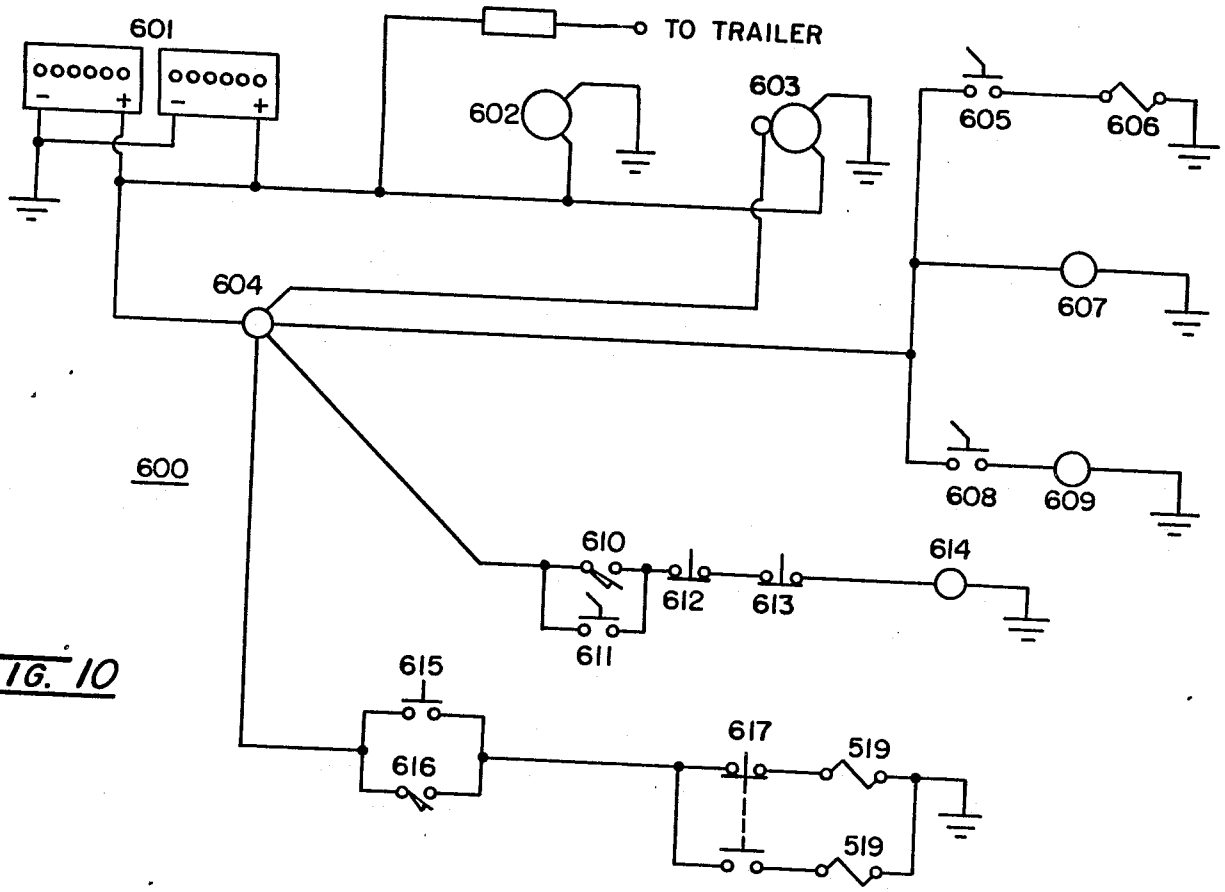
FIG. 10. is a schematic view of the electrical system of the invention.
Figure 11:
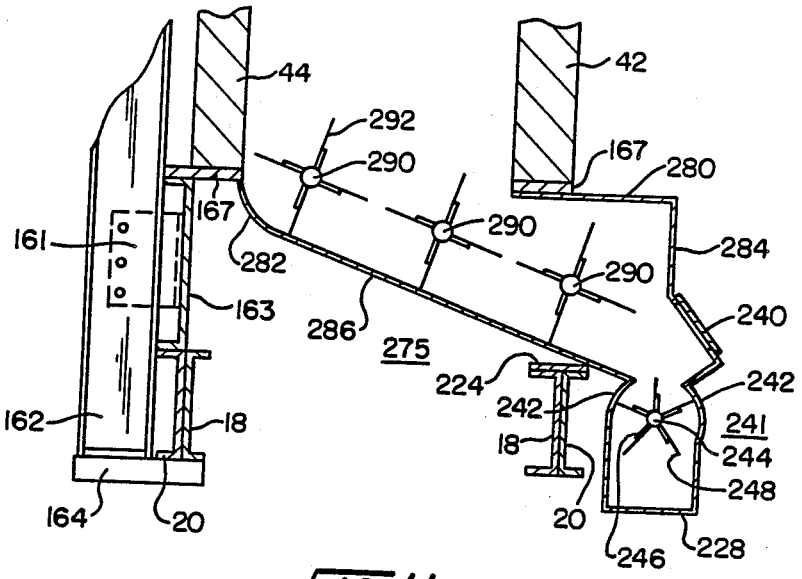
FIG. 11. is a partial transverse vertical sectional taken on line number 3—3 of a second embodiment of the chip removal system.

As shown in FIG. 1, this invention, a truck-mounted, solid waste material shredder or chipper 100, consists of a mobile highway-type motor vehicle 10 with chassis 18, a shredding means 40 (FIG. 2) mounted on said chassis, a drive means 80 for selectively operating the vehicle 10 or the shredder 40 (FIG. 5), a drive stress reducing means 120 placed between the drive means 80 and the shredder 40 so as to reduce the torsional strain produced by the shredder 40 on the drive means 80, a lifting or feed means 160 (FIGS. 2, 3, 7 and 8) for lifting materials to be shredded into the shredder 40, a shredded material removal means 200 for removing the shredded wood from the shredder 40 (FIGS. 2, 3 and 11). In addition, the truck mounted shredder 100 also has a trailer means 250 for holding the shredded material, a hydraulic means 500 (FIG.9) and an electrical means 600 (FIG. 10) for operating the various components of the invention.

As shown in FIG. 1, the vehicle consists of a cab 12 for conveying passengers and enclosing engine 14 and transmission 16 and a chassis 18 for supporting the vehicle drive means 80 (FIG. 5) and the shredding means 40 and also pulling the trailer system 250. The vehicle and chassis 10 is a modified truck, model number 2275 made by the International Corporation of Detroit, Mich. The truck is approximately 20 to 25 feet in overall length. The chassis 18 has been strengthened by the addition of channel reinforcement members 20 (FIG. 3) attached to the outside of frame members 18, preferably using nuts and bolts in predrilled holes that match existing frame holes.

As shown in FIGS. 2 and 3, the shredding means (shredder) 40 consists of a housing having a first side or wall 42 and a second side or wall 44, a front side or wall 46 and a back side or wall 48. The bottom and top of the housing are left open to form an inlet port at the top for receiving solid waste material and an outlet port at the bottom of the housing for discharging shredded waste material. A rotary cutter shaft 50 is mounted in the front and rear walls 46 and 48 and extends therethrough in a direction generally parallel with the chassis 18 of the truck. The cutter shaft 50 is provided with a circular drum 52 which is coaxially fastened on the cutter shaft 50 and rotates within the interior of the shredder 40. Cutters 54 are mounted in longitudinal rows on the circular drum 52. The plane of the cutters is perpendicular to the axis of the cutter shaft 50.

A hemispherical plate 60 conforms generally to the surface defined by the outer edge of the rotating cutters and is so mounted as to permit free rotation of the cutters 54 within the plate 60. The hemispherical plate 60 is mounted to the shredder housing by means of ledges or shoulders 56 and 58 projecting from sidewalls 42 and 44, respectively. The hemispherical plate 60 is provided with apertures or openings 62 in the lower portion of the plate 60 and between the supporting ledges 56 and 58 so as to permit shredded material to fall therethrough. Anvils 64 are mounted on the hemispherical plate 60 in such a fashion so that the cutters 54 rotate between the anvils 64.

The front and back walls (42 and 44, respectively) of the shredding means 40 are securely mounted to channel members 163 which are rigidly secured to structural reinforcement members 20. Preferably vibration cushions 167 are placed between channel members 163 and reinforcement members 20 to reduce the amount of vibration transmitted to the truck from the shredder 40.

Shredders are commercially available such as from Montgomery Industries International, Inc., Jacksonville, Fla. Such shredders are designed for permanent installation, typically securely anchored on a concrete pad and are often more than fifteen feet tall. Such heights are used so as to minimize the discharge of shredded particles from the top of the shredder.

One aspect of the present invention was to modify a commercial shredder so that it could be mounted on a truck chassis. To meet state highway height requirements, the duct work at the top of a commercial shredder is removed and as shown in FIGS. 2 and 3, a hood 70 is securely fastened over the top of the shredder to prevent the discharge of shredded fragments from the top of the shredder. The hood has a front 76, a back (not shown), and a side and top 78 formed of one piece of material leaving an opening to the other side and an opening in the bottom to permit solid waste material to be loaded therethrough and through the inlet port of the shredder 40.

To further minimize the discharge of material from the top of the shredder 40 (side opening of hood 70), a set of resilient straps 72 is hung from the top of the hood opening to the top of shredder side wall 44 to form a segmented curtain through which the waste material to be shredded can easily pass into the shredder 40 but which prevents shredded material from leaving the shredder.

Figure 5:
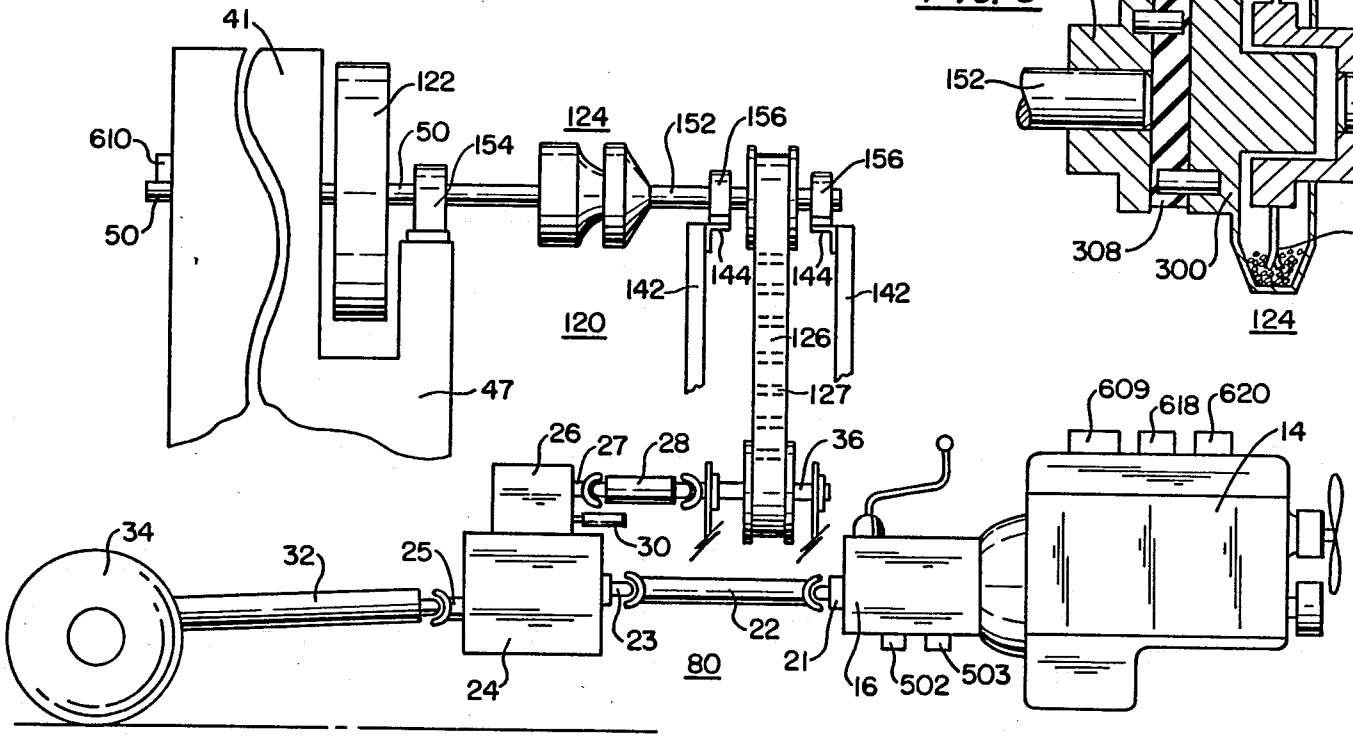
FIG. 5. is a semi-schematic drawing of the drive means and drive stress reducing means.

A deflection plate 74 is securely attached to shredder side wall 44, shredder back wall 48 and shredder front wall 46 so as to slant up and away from shredder side wall 44 in order to deflect shredded particles away from the hood opening so as to further minimize the about of debris escaping from the top of the shredder means 40. As seen in FIG. 5, the drive means 80 for selectively operating the vehicle 10, i.e., the vehicle drive wheels 34, or the shredder means 40, i.e., the cutter shaft 50, consists of a heavy-duty truck-type engine 14 such as a 350 horse power motor from Cummins Diesel Motor, Columbus, Ind., a first transmission 16 such as a Spicer heavy duty seven speed transmission for producing selected amounts of speed or torque, an auxiliary transmission 24 such as a Spicer four speed transmission, a power take off unit 26 which provides the gearing by which the input from the truck motor can be switched between the truck drive means and the shredder drive means and a selection means 30 for choosing between the truck drive output 25 or the shredder drive output 27. The truck transmission output 21 is joined to the auxiliary transmission input 23 by means of drive shaft 22. A vehicle drive shaft output 25 from the auxiliary transmission 24 powers the drive wheels 34 by means of drive shaft 32. The shredder output drive 27 from the auxiliary transmission 24 emerges from the power take off 26 and is linked to a pulley drive shaft 36 by shredder drive shaft 28.

In order to reduce the unusually high amount of stress and strain produced by the shredder 40 on the transmissions 24 and 16 and on the truck engine 14, it is essential that a stress reducing means 120 be employed. As seen in FIGS. 1, 2, 4 and 5, the stress reducing means 120 consists of a fly wheel 122, a torsional stress reducing coupling or connecting means 124 and a drive belt 126. The fly wheel 122 is mounted on the cutter shaft 50 and is supported in a reverse J-shaped structure 47 which is part of the shredder housing front wall 46. The cutter shaft 50 is supported on shredder housing J-structure 47 by means of support bearing 154.

Figure 6:
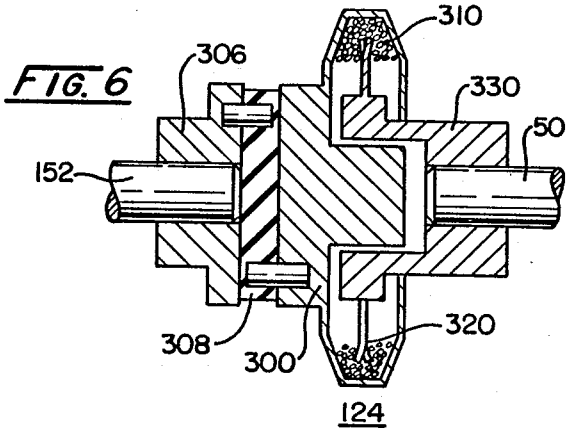
FIG. 6. is a cross sectional drawing of a dry fluid coupling.

A dry-fluid torsional stress reducing connecting (coupling) means 124 is shown in FIG. 6. Cutter shaft 50 is securely affixed to rotor 330 which has rotor fins 320. The upper drive shaft 152 is securely attached to coupling housing member 306, which is in turn securely fastened to shock-absorbing material 308, which is in turn securely fastened to coupling housing 300 which contains a dry drive fluid such as a metal shot 310. As housing 300 comes up to speed, the centrifugal force drives the shot to the outermost portion of housing 300. As the shot is packed firmly against the outer wall of the housing 300, the rotor fins 320 become firmly imbedded in the shot and rotate with the upper drive shaft 152. Typically it takes approximately 12 seconds for cutter shaft 50 to obtain the same speed as upper drive shaft 152. Dry-fluid couplings are commercially available. Preferably a coupling such as the Type PH Flexidyne Coupling is used. Because dry-fluid couplings are designed for electrical motors with a constant rotational speed, they would soon burn out if subjected to the varying speeds of a variable speed engine such as a truck engine. In order to overcome this problem, an electronic governor 609 was installed on engine 14 to achieve a constant rotational speed when the coupling means 124 is in use.

As may be noted, the coupling means 124 is depicted in several different shapes in FIGS. 1, 2, 5 and 6. These different shapes represent contemplated equivalent coupling means which are capable of reducing substantially the torsional stress and strain between the engine 14 and the shredding means 40 such as wet fluid means and other devices that allow the drive shaft 152 to remain at a relatively constant rotational speed while the output shaft is allowed to vary because of differences in rotational speed due to the stress and strain produced by the shredding activity.

As shown in FIGS. 1, 2, 4 and 5, the stress reducing means 120 is supported by a support frame 130 which consist of upright members 142 which are attached to chassis members 18 and chassis support members 20 at there lower end. At the upper end of upright members 142, they are securely attached to upper pulley shafts support members 144. Upper pulley shaft support members 144 generally are transverse to the chassis of the truck. The upper pulley shaft support members 144 have support bearings 156 attached to them by means of bolts 155.

To give further structural strength to the upright members, cross members 146 are also connected to the upper portion of the upright members 142 in a direction parallel with the direction of chassis members 18. To add further support and strength to structure 130, a diagonal member 148 is attached to support members 142.

Drive shaft 36 is supported by plates 135 and 137 which have a hemispherical slot cut in one end so as to form a circular aperture through which drive shaft 36 is held in place. Plate 135 is attached to angle iron 131 which is supported between chassis members 20 by angle bracket 133. Angle bracket 131, in addition to supporting drive shaft 36, also adds additional strength and stability to the truck chassis members 18 and reinforcement members 20.

Drive shaft 36 and drive shaft 152 are rotationally connected by drive belt 126 and supporting pulleys 128. Because ordinary V belts and V notched pulleys tend to experience undue stretching under the conditions found in this invention, the rib pulley 126 with ribs 127 and pulleys 128 with mating notches 129 (FIG. 2) were used to avoid the undue stretching produced by the apparatus.

Figure 7:
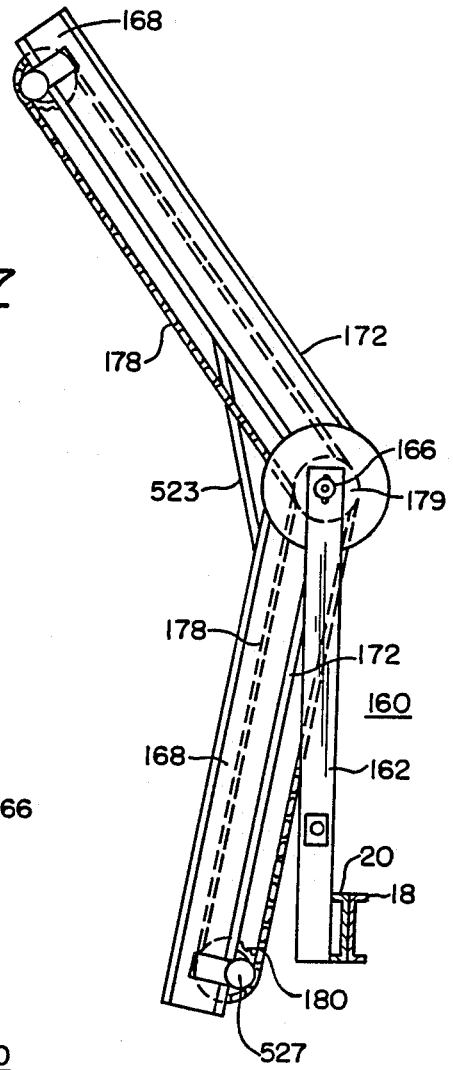
FIG. 7. is a side view of a second embodiment of the feed conveyor.
Figure 8:
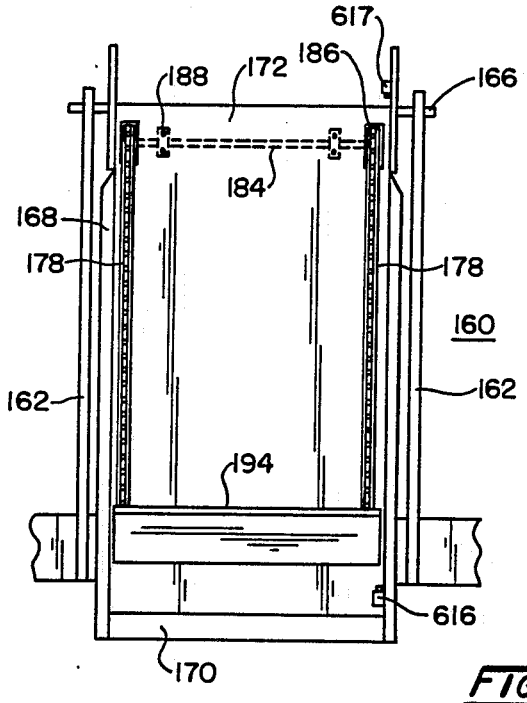
FIG. 8. is a front view of the second embodiment of the feed conveyor.

As shown in FIGS. 2, 3, 7 and 8, a special lifting device or means 160 is provided to enable solid waste objects such as wooden pallets to be lifted from operator level into the inlet port of the shredder. The embodiment in FIGS. 7 and 8 is preferred and is described here with variations noted. Essentially the lifting means consists of a flat box like structure which is pivotally attached to the top of two frame members 162 that are securely attached to the chassis 18 of the truck 10 and to the shredder means 40. The box like structure rotates about the pivot rod 166 (FIG. 8) and is lifted up to an upright position by hydraulic cylinder 523 (FIG. 9 preferred) and hydraulic cylinders 190 (FIGS. 2 and 3). In the upper most position, a push plate 194 inside the box-like structure forces the wooden materials out of the box like structure and into the shredder means 40; the push plate 194 and the hydraulic cylinder 523 then return to the normal loading position automatically.

The lifting means 160 consists of two frame members 162 which are attached at their bottom ends to a support member 164 which is attached to the bottom of chassis member 18 and reinforcing member 20, to side channel 163 by means of bracket 161, and to the side wall 44 of the shredder means 40 by angle bracket 165. The box-like structure consists of side members 168, bottom member 170 and a back member 172. The side members 168 are securely attached to the sides of back member 170 at right angles and extend beyond the back member 170 at their upper ends. The upper ends of side members 168 are pivotally secured to the upper ends of the upright frame members 162 by pivot rod 166. The box-like structure is raised and lowered by means of a hydraulic cylinder 523 which is attached to wall 44 of said shredder means (not shown) and to the bottom or underside of back member 170 (not shown). An inclined plate 68 is securely attached to the top of side wall 44 and to the upright frame members 162 so as to slant downward into the entry port of the shredding means 40 so as to form an incline for directing solid waste material into the shredding means 40 from the box-like structure.

The box like structure is further equipped with two or more upper sprockets 179 which are secured to a rotatable shaft 184 that is mounted on the underside of back member 172 near the top edge with support bearings 188 so that a portion of the sprockets 179 project through a rectangular slot 186 in the back member 172. A drive shaft is rotatably secured to the underside of back member 172 and has two drive sprockets 180 securely attached to the drive shaft in a manner similar to that for upper shaft 184. The lower drive sprockets 180 also project through rectangular slots in the back member 172 and vertically align with the upper sprockets 180. Drive chains 178 are wrapped around an upper sprockets 180 and a drive sprocket 180. A push plate 194 is mounted transversely across the drive chains 178. The lower sprocket 180 has a hydraulic drive means 527 such as a hydraulic motor connected to the sprocket which enables the push plate 194 to move up and down the length of the box.

As shown in FIG. 3, the shredder removal means 200 consists of an L-shaped housing having a top plate 212, a bottom plate 218, and end plate 220, outer side plate 214 and inner side plate 216 (short leg of L-housing), and a front plate 222 and back plate (not shown). The bottom plate 218 is attached to chassis member 18 at one end and is attached to chassis member 18 and supporting member 20 toward the L-shaped end. Preferably vibration pads 224 and 226 are placed between bottom plate 218 and chassis members 18 and reinforcing member 20. The shredder removal means 200 is completely inclosed except for an opening port at one end of top plate 212 and an air stream entrance and exit port located in the front plate 216 and back plate in the short leg portion of the L-portion of the housing. A continuous belt 202 runs the length of the long portion of the L-shaped housing and conveys the wood chips from the exit port of the shredder to the opposite end of the housing. The continuous belt 202 is supported on drive roller 204 and auxiliary roller 206. Drive roller 204 is driven by a hydraulic motor (FIG. 2) 513. Generally the belt 202 operates in a direction that is transverse to the chassis of the truck carrying the wood chips falling beneath the shredder to a point to the side of the truck where they fall into the short portion of the L-shaped housing. As shown in FIG. 2, after the shredded wood chips fall in the short portion of the L-shaped housing 210, they enter a pressurized air duct system which consist of a blower 230 having air inlet ports 234, and an exhaust duct 228. The blower 230 is driven by a hydraulic motor 509.

In order to prevent air from blowing into the shredder mechanism, an air lock is provided which consists of drive shaft 244 which is mounted in the front plate 222 and back plate in the short L portion of the shredded wood removal means 200. Metal fins 246 are longitudinally mounted along the drive shaft 244 to give rigidity to the resilient paddles 248. The resilient paddles 248 are of such length that at any one time at least two of them make simultaneous contact with outer side plate 214 and inner side plate 216. Because of this contact with side plates 214 and 216, air is not able to enter into the conveyor belt section of the shredder removal means. As shown in FIG. 2, the air lock shaft 244 is driven by a rigidly attached sprocket or pulley 238 which is connected to sprocket or pulley 239 by means of chain or belt 237. As the wooden chips fall through the air lock into the air duct they are conveyed to trailer means 250 by air duct 228.

In order for the operator to be able to view possible jam ups within the air lock system, a transparent shatter-proof air tunnel window 240 is provided for visual observation. As shown in FIG. 11, additional walls may be added to the waste removal system so as to provide a better viewing angle through the transparent window 240.

In the alternate and preferred embodiment of the waste removal means shown in FIG. 11, the waste removal means 275 has a paddle means housing with a front and a back (not shown), a top 280 with an inlet port below the shredding means 40, a rounded first side 282, a second side 284, a bottom 286 sloping down and away from said first rounded side 282 and having an exit port at the lower part of the sloping bottom 286. The paddle means housing is mounted transversely across the chassis 18 so as to empty shredded materials to the side of the truck or motor vehicle 10. One or more paddle shafts 290 are rotatably mounted to the front and back of the paddle housing and extend through the front of the paddle housing. The paddle shafts 290 have resilient paddle blades 292 longitudinally attached to the paddle shafts 290 along the length of the paddle shaft 290 of such length so as to extend out radially to touch the paddle means housing bottom 286. A rigid paddle blade support 294 of lesser length than said resilient paddle blades 292 is attached to the paddle shaft 290 and to a portion of the paddle blade 292 nearest to the paddle shaft 290. Alternatively only the paddle blade support 294 need be attached to the paddle shaft 290 with the resilient paddle blades 292 being attached to the paddle blade support 294. The later arrangement allows for the rapid change of paddle blades 292 when they become worn or damaged.

The paddle shafts 290 are driven by a hydraulic motor 513 by means of belts or chains passing around pulleys or sprockets attached to the drive shaft 233 of the hydraulic motor and to pulleys or sprockets attached to paddle shafts 290 on the outside of the front side of the paddle housing. Although not illustrated, the chain and sprocket system for driving the paddle shafts 290 is similar to pulley 237 and sprockets 238 and 239 used to drive the air lock shaft 244. Both the paddle shafts 290 and the air lock shaft 244 may be driven off of hydraulic motor 213. The paddle shafts 290 are rotated in a counterclockwise direction so as to sweep shredded waste material down the sloping bottom 286 and into the exit port located at the lower end of the sloping bottom 286.

The exit port of the paddle waste removal means may be connected directly to a pressurized air removal means 227 (FIG. 2). Such a pressurized air removal means 227 consists of a fan assembly or blower 230, an air intake means (air inlet ports) 234, and an air discharge duct 228 with an opening therein to receive shredded waste material from the exit port in the slopping bottom 286 of the paddle waste removal means 275. A hydraulic motor 509 drives the fan assembly 230 by means of a hydraulic output shaft connected to a blower shaft 229 by a flexible coupling 236 to correct for slight misalignment and vibrational stress.

To reduce the amount of air that enters into the waste removal means 200 (FIG. 2) or 275 (FIG. 11), deflection plates 247 are rigidly attached to the upper portion of the air discharge duct 228 so as to slant down and away from the inlet opening or port for receiving shredded material so as to deflect the pressurized air down and away from the inlet port or opening.

As shown in FIG. 11, preferably an air lock means 241 is connected between the paddle waste removal means 275 and the pressurized air removal means 227 to minimize the amount of pressurized air that enters the shredding means 40. The air lock means 241 has circularly shaped sides 242 and a front end and a back end (not shown) with an inlet port at the top for receiving shredded solid material from the exit port of the paddle waste removal means 275 and an exit port at the bottom for discharging shredded waste material into the opening at the top of air duct 228 for receiving shredded waste material. The air lock means 241 is attached to the paddle waste removal means 275 so that the exit port of the paddle waste removal means 275 and the inlet port of the air lock means coincide. The air lock means 241 is attached to the pressurized air removal means 227 so that the inlet port in the air duct 228 coincides with the exit port of the air lock means 241. A rotatable air lock shaft 244 is rotatably mounted in the front and back ends of said air lock means and extends through said front end. A plurality of resilient paddles 248 are mounted radially along the length of the air lock shaft 244 within the air lock means 241 and extend outwardly so as to touch the circular sides 242 so that at least one such paddle 248 is in contact with each circular side 242 so as to prevent any air from entering into the waste removal means 275 or 200. A rigid support member 246 is attached to the air lock shaft and to a portion of the resilient paddle 248. A contemplated equivalent of this arrangement is the attachment of the rigid support member 246 to the air lock shaft with the attachment of the resilient paddle 248 to the rigid support member 246. The air lock shaft 244 is driven by hydraulic motor 513 by means of pulleys or sprockets 238 and 239 connected by a belt or chain 237.

The preferred trailer means 250 has a moveable floor for quick unloading such as the commercially available Keith Running Floor II made by Keith Manufacturing of Wadras, Oreg. The movable floor of the trailer allows for rapid unloading of the chips from the trailer. Essentially the moving floor consists of a plurality of boards about four inches wide mounted lengthwise so as to form the floor of the trailer. A hydraulic means driven by pump 503 moves the boards back and forth in relation to one another for a short distance so as to shake the shredded material out of the trailer 250.

The front wall 270 of the trailer has an inlet port 262 in the upper corner for receiving the exhaust duct 228 (FIG. 1). An exhaust port 264 is located in the opposite corner of the front wall. Flexible tubing 266 is run from the exhaust port 264 to the input port 235 of the blower 230 to reduce pressure buildup in the trailer means 250 and to also reduce the amount of dust entering the atmosphere.

As shown in FIG. 1, the trailer means 250 can be attached to the chassis 18 by means of a slidable locking means such as a fifth wheel made by Fruehauf of Columbus. Ohio. The fifth wheel slides forward and backward as indicated by the arrow and can be locked into a forward or backward position by means of hydraulic spring loaded pins. For highway use, the fifth wheel is locked in the backward position. in such a position, the duct 228 is with drawn from the entrance port 262 and the truck and trailer can easily negotiate turns without damaging the exhaust duct 228. At the work site, the fifth wheel 360 is locked in the forward position after the exhaust duct 228 has been backed into the entrance port 262.

Figure 9:
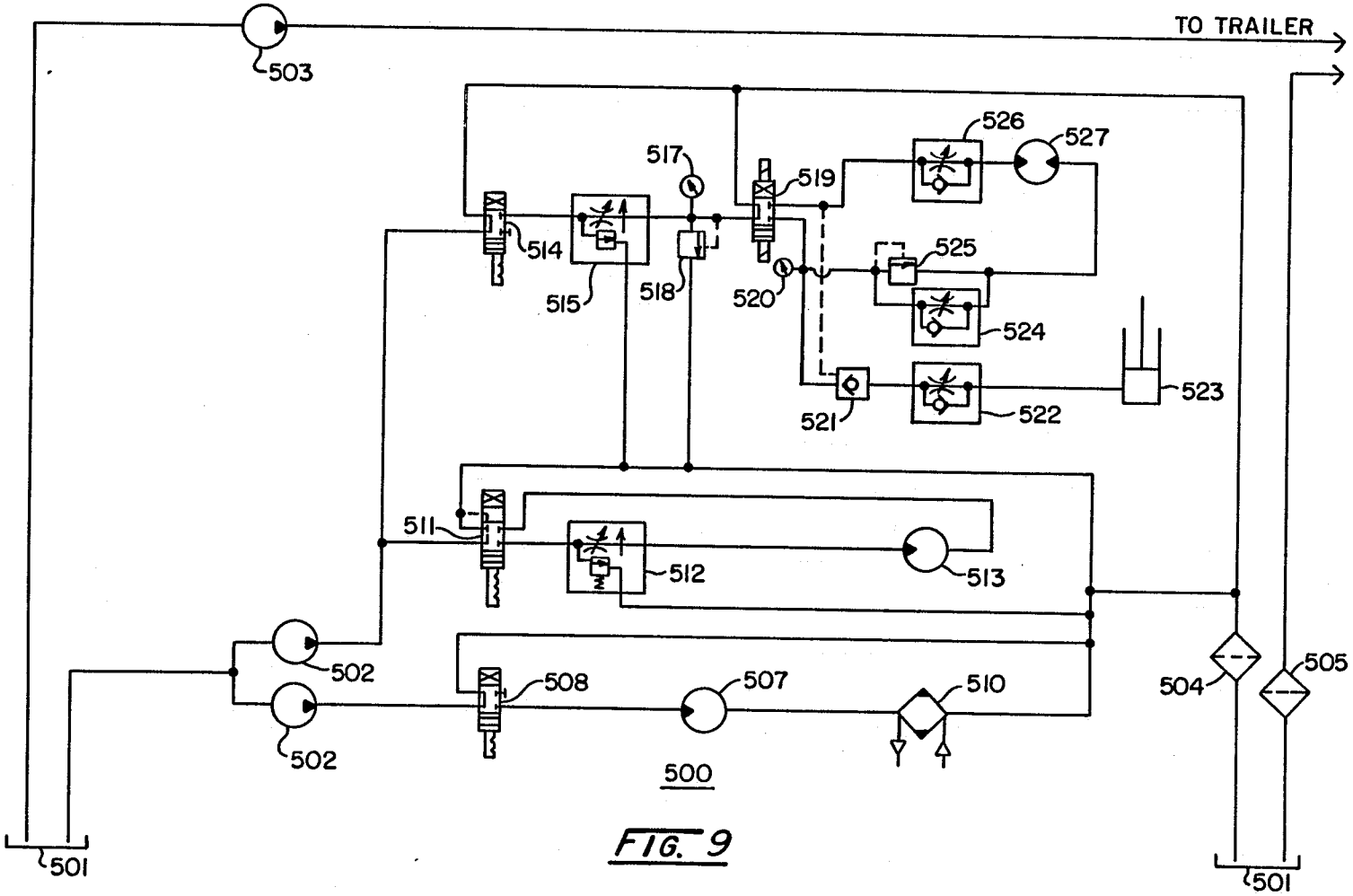
FIG. 9. is a schematic view of the hydraulic system.

The hydraulic means 500 is shown in FIG. 9. A hydraulic reservoir is mounted to the chassis and hydraulic pumps 502 and 503 are driven by truck transmission 16 (FIG. 5). The pumps are activated by 2 manual 3 way air valves 528 and 529 located in the truck cab 12 (FIG. 1). Pump 502 is a double pump having two outputs. It powers the blower motor 509 with one pump section and the lifting means 160 and shredder removal means 200 with the other. Pump 503 is a single pump used to power the trailer unloading running floor system. Filters 504 and 505 filters the hydraulic fluid as it returns to reservoir 501 from pumps 502 and 503, respectively. Gages 517 and 520 give the hydraulic pressure to the lifting means 160 and the lift cylinder 523, respectively. The respective components of the hydraulic means 500 are joined by suitable hydraulic lines.

The blower motor 509 is a hydraulic motor powered by one pump section of pump 502. The motor 509 is turned on by a manual four-way hydraulic valve 508. The blower motor 509 can be run in one direction only. A hydraulic oil cooler 510 located in front of the truck's radiator is used to cool the hydraulic fluid.

The other section of the pump 502 operates the discharge means motor 513, feed lift cylinder 523 (or alternative embodiment 190 shown in FIGS. 2 and 3) and feed motor 527. Discharge means motor 513 is controlled by a manual four-way valve 511 and a flow control valve 512 to regulate its speed. The discharge motor 513 can be ran in both directions for unjamming the shredder removal means 200 or 275.

The lifting means (feed conveyor system) 160 is controlled by a manual four-way valve 514 and flow control 515. The lifting means (feed conveyor) 160 operates automatically after the operator pushes a start button (switch) 615 on the conveyor. After button 615 is pushed, four-way hydraulic valve 519 activates the lift cylinder 523 and starts the chains 178 and push plate 194 moving off the bottom stop switch 616. The chains 178 and the push plate 194 are automatically retracted to the loading position when the push plate reaches its upper position and trips reversing switch 617 reversing valve 519. The feed hydraulic system has a relief valve 518 to control the operating pressure. A sequence valve 525 with a one way flow control valve 524 bypassing it allows the fed motor 527 to start moving in order to release stop switch 616. The push plate 194 pushes the pallet into the shredder after the feed conveyor cylinder 523 reaches its full stroke and the sequence valve 525 applies full flow to the push plate (feed) motor 527. A check valve 521 is connected to the lift cylinder 523 to stop the conveyor from dropping in case of a hydraulic line break. The lift cylinder 523 speed is controlled by flow control 522.

The electrical system 600 is shown in FIG. 10. All electrical devices are operated from the truck batteries 601, alternator 602, starter 603 and ignition switch 604. An electronic governor 609 is used to control the speed of the engine 14 while the vehicle is operating in shredding mode and is itself controlled by switch 608. The time use recording means 607 is a graph timer that records the operating time while driving the vehicle 10 and while using the shredding means 40.

Toggle switch 605 is a switch that operates the solenoid that operates the four-way single solenoid air valve 606 that operates the first pneumatic piston 30 (FIG. 5) and the second pneumatic piston (not shown). The first pneumatic piston 30 is activated by the switch 605 through an air valve 606 and engages or disengages an output shaft from the engine 14 such as output shaft 21 from the first transmission 16 or the output shaft 25 from the second transmission 24 to the means for propelling the vehicle 34. The second pneumatic piston is simultaneously activated by the switch 605 through air valve 606 and engages an output shaft from said engine such as output shaft 27 to an input shaft such as input shaft 36 to the torsional stress and strain reducing means 120 when the first pneumatic piston is disengaging an output shaft from the engine 14 to the means for propelling the vehicle 34. The second pneumatic piston disengages an output shaft from said engine 14 to an input shaft to the torsional stress and strain reducing means 120 when the first pneumatic piston is engaging an output shaft from the engine 14 to a the means for propelling the vehicle.

It is to be noted that the engine 14 is considered to have several outputs which are considered to be equivalent although not preferable at the time of application. For example, the engine could be directly linked to the means for propelling the vehicle 34. The engine could also be linked to a first transmission 16 and then to the means for propelling the vehicle. Finally and preferably, the engine 14 could be linked to a first and then a second transmission 24 and then to the propelling means 34. Similarly, there are several ways that engine 14 could be linked to some or all of the various components of the torsional stress and strain reducing means 120. These linkage methods are all considered to be equivalent and will operate this invention with varying degrees of success. The linkage depicted in FIG. 5 is preferred.

Sensor 610 senses the rotational speed of cutter shaft 50 and shuts down the electronic fuel pump 614 in response to a decrease or stop in the rotation of cutter shaft 50. Switch 611 is a bypass switch for sensor 610 to allow the engine 14 to be operated on the road when the cutter shaft 50 is not operating. Oil pressure sensor 618 (FIG. 5) senses the oil pressure of the engine 14 and also shuts down the fuel pump 614 when the oil pressure drops below a certain pressure. Temperature sensor 620 (FIG. 5) senses the temperature of the engine 14 and also shuts down the fuel pump 614 when the temperature exceeds a certain value. Operator safety cut off switch 612 is mounted on the outside of one of the two side members 168 while operator safety cut off switch 613 is mounted on one of the frame members 162. A start switch 615 activates the hydraulic motor 527 so as to advance the push plate 194 up and off of conveyor stop switch 616 causing it to close which in turn activates hydraulic feed (lift) cylinder 523 to raise the lifting means (feed conveyor) 160 into its upper position and allows push plate 194 to continue to advance toward the top of the lifting means 160. When the push plate 194 reaches its upper position it contacts reversing switch 617 causing the hydraulic lift cylinder to lower the lifting means 160 to its lowered position and also causing the hydraulic (feed) motor 527 to reverse and cause push plate 194 to return to its lower position. The cycle is completed when push plate 194 contacts stop switch 616 which stops hydraulic feed motor 527.

It may be possible that minor changes and configurations to other than what was shown, but that which is shown is preferred and typical.

Without departing from this spirit of this invention, various means of fastening material together may be used.

Is therefore understood although the present invention has been specifically disclosed with preferred embodiment and examples, modifications to the design concerning size and shape may be apparent to those skilled in the art, and such modifications and variations are considered to be within the scope of the invention and the appended claims.

What is claimed is:

1. A mobile, highway-useable, solid waste material reducing machine comprising:
   a. a mobile highway-type vehicle having a chassis;
   b. a shredding means mounted on said chassis;
   c. a drive means mounted on said mobile vehicle for selectively operating said mobile vehicle and said shredding means;
   d. a torsional stress and strain reducing means connected between said drive means and said shredder means for reducing torsional stress and strain to said drive means;
   e. a lifting means attached to said chassis for lifting waste material into said shredding means; and
   f. a removal means for removing shredded waste material from said shredding means.

2. A mobile, highway-useable, solid waste material reducing machine as described in claim 1 with said torsional stress and strain reducing means comprising:
   a. a flywheel mounted on a rotatable shredder cutter shaft attached to said shredding means and
   b. a torsional stress reducing connecting means for connecting said rotatable shredder cutter shaft to a drive means shaft.

3. A mobile, highway-useable, solid waste material reducing machine as described in claim 2 with said torsional stress-reducing connecting means being a dry fluid coupling means.

4. A mobile, highway-useable, solid waste material reducing machine as described in claim 3 with said torsional stress and strain reducing means further comprising a governing means attached to said drive means for controlling the rotational speed of said drive means.

5. A mobile, highway-useable, solid waste material reducing machine as described in claim 4 wherein said governing means for controlling said rotational speed of said drive means is an electronic governing means.

6. A mobile, highway-useable, solid waste material reducing machine as described in claim 1 with said lifting means for lifting waste material into said shredding means comprising:

a. two upright frame members rigidly attached to said vehicle chassis and said shredding means;

b. a box-like structure with a back member and two side members perpendicularly secured to said back member with each of said side members extending upward beyond said back member and pivotally secured near an upper end of each of said side members to the upper portion of said upright frame members by a pivot means;

c. means for rotating said box-like structure about said pivot means so as to empty solid waste materials in said box-like structure into said shredding means.

7. A mobile, highway-useable, solid waste material reducing machine as described in claim 6 further comprising a feed plate rigidly attached to said shredding means and said upright frame members and slanting downward into said shredding means so as to form an incline for directing solid waste material into said shredding means from said box-like structure.

8. A mobile, highway-useable, solid waste material reducing machine as described in claim 6 wherein said means for rotating said box-like structure about said pivot means is a hydraulic means attached to said shredder and to the underside of said back member.

9. A mobile, highway-useable, solid waste material reducing machine as described in claim 6 with said lifting means for lifting waste material into said shredding means having a feed means for clearing waste material from said box-like structure comprising:

a. at least two upper rotatably secured sprockets secured to a rotatable shaft that is mounted on the underside said of said back member near the top edge of said back member so that a portion of said sprockets project through a rectangular slot in said back member;

b. a drive shaft rotatably secured to the underside of said back member near the bottom edge of said back member and having at least two lower drive sprockets aligning with said upper sprockets with a portion of said drive sprockets projecting through rectangular slots in a lower portion of said back member and;

c. two or more drive chains, each passing around one of said drive sprockets and one of said upper sprockets;

d. a push plate transversely mounted on said drive chains so as to be parallel to a bottom edge of said box-like structure and capable of traveling from the bottom to the top of said box-like structure and back therefrom; and e. means for moving said push plate from said bottom to said top of said box-like structure and back therefrom.

10. A mobile, highway-useable, solid waste material reducing machine as described in claim 9 wherein said means for moving said push plate from said bottom to said top of said box-like structure and back therefrom is a hydraulic means.

11. A mobile, highway-useable, solid waste material reducing machine as described in claim 10 wherein said hydraulic means is a hydraulic motor.

12. A mobile, highway-useable, solid waste material reducing machine as described in claim 11 with said means for moving said push plate from said bottom to said top of said box-like structure and back therefrom further comprising:

a. a start switch for activating said hydraulic motor so as to advance said push plate up and off of a shut off switch attached at the bottom inside portion of said side member;

b. a reversing switch located at the top portion of said side member and causing said hydraulic motor to reverse on contact with said push plate.

13. A mobile, highway-useable, solid waste material reducing machine as described in claim 1 with said single drive means for selectively operating said mobile vehicle and said shredding means comprising;

a. a heavy-duty truck-type engine;

b. a first transmission for varying the speed and torque of an output shaft from said engine; and c. means for selectively connecting an output shaft from said first transmission to a means for propelling said vehicle and to said torsional stress and strain reducing means.

14. A mobile, highway-useable, solid waste material reducing machine as described in claim 13 with said single drive means for selectively operating said mobile vehicle and said shredding means further comprising a shut-off means attached to said engine and operating in response to a rotational speed decrease or stoppage of a rotatable cutter shaft of said shredding means.

15. A mobile, highway-useable, solid waste material reducing machine as described in claim 13 with said single drive means for selectively operating said mobile vehicle and said shredding means further comprising a shut off means attached to said engine and operating in response to an oil pressure decrease in said engine.

16. A mobile, highway-useable, solid waste material reducing machine as described in claim 13 with said single drive means for selectively operating said mobile vehicle and said shredding means further comprising a shut off means attached to said engine and operating in response to a temperature increase of said engine.

17. A mobile, highway-useable, solid waste material reducing machine as described in claim 13 further comprising a means for connecting an output shaft from said selective connecting means to an input shaft of said torsional stress and strain reducing means.

18. A mobile, highway-useable, solid waste material reducing machine as described in claim 17 with said means for connecting said output shaft from said selective connecting means to said input shaft of said torsional stress and strain reducing means comprising:

a. a first pulley securely attached to said output shaft from said selective connecting means;

b. a second pulley securely attached to said input shaft of said torsional stress and strain reducing means and aligned with said first pulley; and c. a belt means passing around said pulleys on said selective connecting means output shaft and said torsional stress and strain reducing means input shaft so as to couple said rotation of said selective connecting means output shaft to said torsional stress and strain reducing means input shaft.

19. A mobile, highway-useable, solid waste material reducing machine as described in claim 18 wherein said pulley belt groove is flat with parallel notches that mate with corresponding transverse ribs on the inner side of said belt.

20. A mobile, highway-useable, solid waste material reducing machine as described in claim 1 comprising:

a. an engine;

b. a first transmission connected to said engine;

c. a second transmission connected to an output shaft from said first transmission;

d. means for selectively connecting an output shaft from said second transmission to a means for propelling said vehicle and to said torsional stress and strain reducing means.

21. A mobile, highway-useable, solid waste material reducing machine as described in claim 1 with said means for selectively connecting an output shaft from said engine to a means for propelling said vehicle and to said torsional stress and strain reducing means is an electrical air-pneumatic means.

22. A mobile, highway-useable, solid waste material reducing machine as described in claim 21 with said electrical air-pneumatic means comprising:

a. an electrical switch, b. a first pneumatic piston activated by said electrical switch through a solenoid air valve and engaging and disengaging said output shaft from said engine to said means for propelling said vehicle, and c. a second pneumatic piston simultaneously activated by said electrical switch through said solenoid air valve and engaging said output shaft from said engine to an input shaft of said torsional stress and stain reducing means when said first pneumatic piston is disengaging said output shaft from said engine to said means for propelling said vehicle and disengaging said output shaft from said engine to said torsional stress and strain reducing means when said first pneumatic piston is engaging said output shaft from said engine to said means for propelling said vehicle.

23. A mobile, highway-useable, solid waste material reducing machine as described in claim 1 with said shredding means mounted on said chassis comprising:

a. a box-like housing mounted to said chassis and having a first side, a second side, a front side and a back side with an inlet port for receiving solid waster material at the top of said housing and an outlet port at the bottom of said housing for discharging shredded material;

b. a rotary cutter shaft extending through front and back sides of said housing in a direction generally parallel to the drive shaft of said vehicle;

c. a rotating circular drum securely fastened to said rotary shaft and contained within said housing;

d. a plurality of spaced knife-like cutters securely fastened to said circular drum in rows generally parallel to the axis of said rotary cutter shaft and with the plane of each cutter being generally perpendicular to said rotary shaft;

e. a hemispherical plate conforming to the cylindrical surface defined by the outer edge of said cutters and securely fastened to shoulders projecting inwardly from the sides of said housing, said hemispherical plate positioned with the concave surface facing to the top of said housing and having openings through the lower most portion so as to permit wood chips to pass therethrough; and f. a plurality of spaced anvils mounted on the upper inside edges of said hemispherical plate so as to allow the passage of said cutters among said anvils.

24. A mobile, highway-useable, solid waste material reducing machine as described in claim 23 with said shredding means mounted on said chassis further comprising a hood securely attached to the top of said box-like housing and comprising a front, a back, and a side and a top so as to form an opposite side opening for receiving solid waste materials and a bottom opening for the passage of solid waste material to said inlet port of said shredding means housing.

25. A mobile, highway-useable, solid waste material reducing machine as described in claim 24, with said hood further comprising a set of resilient straps attached to said top of said hood and hanging down therefrom to said first side of said shredder to form a segmented curtain over said opposite side opening and allowing for the passage of solid waste material into said shredding means.

26. A mobile, highway-useable, solid waste material reducing machine as described in claim 24 with said shredding means further comprising a deflection plate securely mounted to said first side and front and back of said shredding means in such a manner so as to point up and away from said first side of said shredding means so as to deflect shredded materials away from said opposite side opening of said hood.

27. A mobile, highway-useable, solid waste material reducing machine as described in claim 1 with said removal means for removing shredded waste material from an exit port of said shredding means comprising a pressurized means.

28. A mobile, highway-useable, solid waste material reducing machine as described in claim 1 with said removal means for removing shredded waste wood from an exit port on said shredding means comprising a conveyor means.

29. A mobile, highway-useable, solid waste material reducing machine as described in claim 28 with said conveyor means for removing shredded waste wood from said shredding means comprising:

a. a conveyor belt housing having a front, a back, a top, a bottom, and two sides and mounted transversely across said chassis of said vehicle and below said shredding means and having an inlet port directly below said shredding means to receive shredded waste falling from said shredding means and an exit port in said bottom of said housing and at an end opposite to said inlet port to discharge said shredded waste in a direction generally downward and to the side of said chassis;

b. at least two rollers one of which is a drive roller mounted through the front and rear of said conveyor belt housing in a direction generally parallel with the direction of said chassis;

c. an endless conveyor belt placed around said rollers; and d. drive means for operating said conveyor drive roller.

30. A mobile, highway-useable, solid waste material reducing machine as described in claim 1 with said removal means for removing shredded waste material from said shredding means comprising a paddle means.

31. A mobile, highway-useable, solid waste material reducing machine as described in claim 30 with said paddle means for removing shredded waste wood from an exit port on said shredding means comprising:

a. a paddle means housing attached to said shredding means and mounted transversely across said chassis and comprising:
(1) a front,
(2) a back,
(3) a top having an inlet port directly below an exit port of said shredding means,
(4) a rounded first side,
(5) a second side,
(6) a bottom sloping down and away from said first rounded side and having an exit port at a lower part of said sloping bottom;

b. at least one paddle shaft rotatably attached to said front and back of said paddle means housing with one or more radial resilient blades attached longitudinally to said paddle shaft;

c. drive means for rotating said paddle shaft so as to sweep shredded waste down said sloping bottom into said exit port.

32. A mobile, highway-useable, solid waste material reducing machine as described in claim 31 with said exit port of said paddle means attached to a pressurized air removal means for removing shredded waste material.

33. A mobile, highway-useable, solid waste material reducing machine as described in claim 32 with said pressurized air removal means for removing shredded waste material comprising:

a. a fan assembly with an air intake means and an air discharge duct;

b. an opening in said air discharge duct for receiving shredded waste material from said exit port on said paddle removal means; and c. drive means for operating said fan assembly.

34. A mobile, highway-useable, solid waste material reducing machine as described in claim 33 with said pressurized air means for removing shredded waste wood further comprising one or more metal plates attached to an upper portion of the sides of said air discharge duct and slanting down and away from said opening for receiving said shredded material and in the same direction as air flow in said air discharge duct so as to deflect pressurized air away from said opening for receiving said shredded material.

35. A mobile, highway-useable, solid waste material reducing machine as described in claim 33 having an air-lock means secured between said paddle discharge means and said pressurized air means.

36. A mobile, highway-useable, solid waste material reducing machine as described in claim 35 with said air-lock means comprising:

a. an air-lock housing having circularly shaped sides and a front end and a back end and attached to said paddle housing so as to receive said shredded waste wood through an inlet port located at the top of said air-lock housing and discharge said shredded waste material into said air discharge duct through an exhaust port located at the bottom of said air-lock housing and attached to said discharge duct;

b. a rotatable air-lock shaft supported by said front end and back end of said air-lock housing;

c. a plurality of resilient paddles mounted radially along the length of said air-lock shaft and touching said circularly shaped sides of said air-lock housing so that at least two said resilient paddles are always in contact with said sides of said air-lock housing; and d. a means for rotating said air-lock shaft.

37. A mobile, highway-useable, solid waste material reducing machine as described in claim 36 with said air-lock means further comprising a rigid support member for said resilient paddle attached to said air-lock shaft and an inner portion of said resilient paddle so as to give said resilient paddle additional support and strength.

38. A mobile, highway-useable, solid waste material reducing machine as described in claim 36 wherein said means for rotating said air-lock shaft is a hydraulic means.

39. A mobile, highway-useable, solid waste material reducing machine as described in claim 35 wherein a portion of at least one wall of said paddle housing is made of a transparent material.

40. A mobile, highway-useable, solid waste material reducing machine as described in claim 33 wherein said drive means for operating said fan assembly is a hydraulic motor.

41. A mobile, highway-useable, solid waste material reducing machine as described in claim 38 wherein an output shaft of said hydraulic motor for operating said fan assembly is attached to a drive shaft of said fan assembly by means of a flexible coupling.

42. A mobile, highway-useable, solid waste material reducing machine as described in claim 33 further comprising an enclosed trailer attached with a slidable locking means to the rear of said vehicle chassis and into which is discharged said shredded waste material from said air discharge duct.

43. A mobile, highway-useable, solid waste material reducing machine as described in claim 42 wherein said discharge duct enters said trailer at an upper corner of the front of said trailer and an air exhaust duct leaves said trailer at an opposite lower corner of said front of said trailer and is attached to said fan assembly air intake means.

44. A mobile, highway-useable, solid waste material reducing machine as described in claim 1 further comprising a hydraulic means for operating said lifting means and said removal means with said hydraulic means comprising:

a. one or more hydraulic pumps driven by said drive means;

b. a hydraulic reservoir containing hydraulic fluid;

c. one or more hydraulic motors;

d. one or more hydraulic pistons;

e. hydraulic lines for joining said hydraulic pump, said hydraulic fluid reservoir, said hydraulic motor, and said hydraulic piston; and f. an electrical means for operating said hydraulic means.

45. A mobile, highway-useable, solid waste material reducing machine as described in claim 1 further comprising a time use recording means for recording the time of operation and rotational speed of said drive means.

46. A mobile, highway-useable, solid waste material reducing machine as described in claim 1 further comprising a vibration damping means between said shredding means and said chassis.

* * * * *